US006257908B1

(12) United States Patent
Le

(10) Patent No.: US 6,257,908 B1
(45) Date of Patent: Jul. 10, 2001

(54) ROTATING ELECTRICAL RECEPTACLE GUARD

(76) Inventor: Liem Le, 1100 S. Butler Way, Lakewood, CO (US) 80232

( * ) Notice: Subject to any disclaimer, the term of this patent is extended or adjusted under 35 U.S.C. 154(b) by 0 days.

(21) Appl. No.: 09/545,815

(22) Filed: Apr. 7, 2000

(51) Int. Cl.[7] ..... H01R 13/44
(52) U.S. Cl. ..... 439/139; 439/143
(58) Field of Search ..... 439/139, 143

(56) References Cited

U.S. PATENT DOCUMENTS 2,455,582 * 12/1948 Hoessel .
2,507,654 * 5/1950 Stubbs .
4,584,430 * 4/1986 Belknap ..... 174/67
5,122,071 * 6/1992 Pridgeon et al. ..... 439/143
5,865,633 * 2/1999 Hou ..... 439/139

* cited by examiner

*Primary Examiner*—Lincoln Donovan
*Assistant Examiner*—Thanh-Tam Le
(74) *Attorney, Agent, or Firm*—Thomas W. Hanson

(57) ABSTRACT

A guard for an electrical receptacle uses a rotating cover to mask the slots in the receptacle. Catch pins engage the cover and hold it in its closed position. Springs means, or similar, automatically return the cover to the closed position. In the preferred form, the catch pins engage the same slots which provide access to the slots in the receptacle, allowing the pins to be released by partially inserting the electrical plug. The cover can then be rotated by turning the plug to align with the receptacle slots. The catch pins move with a certain amount of independence, requiring that both be released separately to allow the cover to turn. The guard may be implemented using a modified housing on the receptacle or as a retrofit cover usable with an existing receptacle.

18 Claims, 6 Drawing Sheets

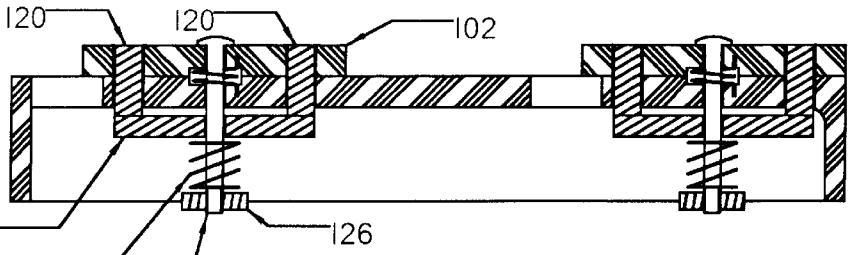
FIG. 9
FIG. 10
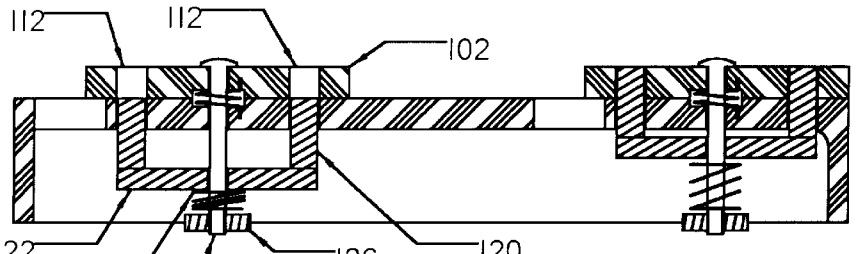
FIG. 11
FIG. 12
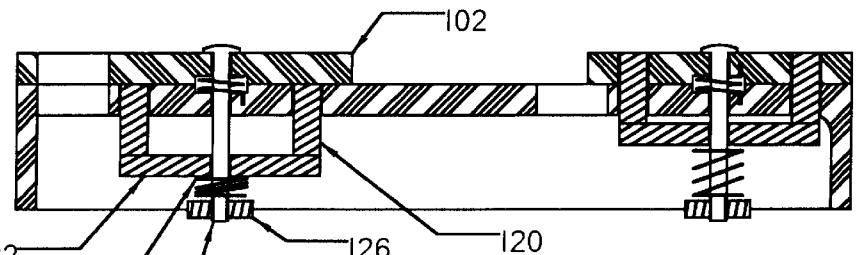
FIG. 13
FIG. 14

ROTATING ELECTRICAL RECEPTACLE GUARD

FIELD OF THE INVENTION

The present invention relates to guards for electrical receptacles and specifically to such guards which are intended to prevent access by babies or toddlers.

BACKGROUND OF THE INVENTION

It is well known that electrical receptacles pose a hazard of electrical shock to babies and toddlers (collectively infants). It is also known to supplement receptacles with guards which inhibit access by infants.

Such guards are available in a variety of designs. The simplest are the removable plugs made of an insulating material such as plastic. These plugs can be inserted into the receptacle and are held in place by the contacts within the receptacle. The design is such that the visible portion of the plug presents a smooth surface which is difficult to grip. The theory behind this approach is that the infants will be unable to remove the plug. Unfortunately, the natural curiosity of infants, once they have seen the plug removed, transforms the guard into a temptation as the infant endeavors to figure out how the plug can be removed. With sufficient effort, toddlers are able to remove the plugs as it actually requires fairly simple motor skills.

Also known are single motion sliding covers. These are typically spring loaded panels or doors which slide sideways to reveal the receptacle. Unfortunately, the motor skills to operate the guard are relatively simple. The guard can often be opened by merely pushing on it at a slight angle, easily achieved by an infant through trial an error.

Receptacle guards become more effective as they become more difficult to use. Unfortunately, they also become increasingly frustrating for adults who need to use the receptacle. The goal is to provide a guard which is difficult to open for infants and easily opened by adults, especially while inserting an electrical plug. Rotational movements are more difficult for infants to master than are linear movements. Combinations of more than one movement are more difficult than single movements, especially where the infant is using trial and error to open the guard. Infants will typically not be attempting to insert an electrical plug, but rather a simpler object such as a paper clip or bobby pin. Since the shapes and dimensions electrical plugs and receptacles are specified by national and international standards, their unique shapes can be exploited as simple keys for opening a guard.

There is a need for a guard for an electrical receptacle which is more difficult to open by infants yet is easily opened by adults. Such a guard should utilize rotational motion to make it more difficult for infants. It should also combine rotational motions with a second required motion to make it even more difficult. Preferably the guard should utilize the characteristic shape of an electrical plug to make it easily opened by using such a plug while being difficult to open with a simpler object of which an infant may come into possession. It is also preferable that the device should be usable with conventional wall plates or as a retro-fit, replacing the wall plate.

SUMMARY OF THE INVENTION

The present invention is directed to an apparatus to guard an electrical receptacle against access by babies or toddlers. According to the invention there is provided a rotatable cover which rotates between at least two positions. In one position, the slots in the receptacle are covered, preventing access. In another position, the slots are exposed, allowing an electrical plug to be inserted. The cover is connected to a spring or other means to return the cover to the covering, or closed, position when released.

According to an aspect of the invention one or more catches are provided which must be released before the cover can be moved from the closed position. Where more than one catch is provided, at least two catches must be separately released to allow movement.

According to another aspect of the invention the catch pins are arranged to be depressed into slots provided in the receptacle housing. The catch pins are arranged such that they engage the slots in the cover through which the electrical plugs prongs pass to enter the receptacle. In this manner, the guard can be opened by partially inserting an appropriate electrical plug, thereby depressing both catches, rotating the plug and cover to expose the slots in the receptacle, and then inserting the plug fully.

Further in accordance with the invention the catch pins may be tapered to limit their travel into the receptacle housing when depressed.

Still further in accordance with the invention, a wall plate may be incorporated so that the cover and the wall plate cooperate to present a smooth face.

Still further in accordance with the invention, the catches which are releasable by the partial insertion of an electrical plug may also be used with other than a rotational motion of the cover.

Yet still further in accordance with the invention, the guard mechanism may be incorporated into a wall plate which is usable with an unmodified receptacle for retrofit purposes.

The advantages of such an apparatus are a guard which requires movements which are difficult for infants yet simple for adults. The guard in its preferred form is easily opened by inserting the appropriate electrical plug but difficult to open without the plug. How to open such a device is not easily learned by an infant through trial and error but easily grasped by an adult. By utilizing the skill differences between infants and adults, and by utilizing the physical characteristics of the electrical plug as a kind of key, a guard is achieved which is easy to open when appropriate and difficult to open when inappropriate.

The above and other features and advantages of the present invention will become more clear from the detailed description of a specific illustrative embodiment thereof, presented below in conjunction with the accompanying drawings.

BRIEF DESCRIPTION OF THE DRAWINGS

FIG. 9 provides a cross sectional view of the guard from the end of the receptacle, with the catch pins engaged.

FIG. 10 provides a cross sectional view of the guard from the side of the receptacle, with the catch pins engaged.

FIG. 11 provides a cross sectional view of the guard from the end of the receptacle, with the catch pins released.

FIG. 12 provides a cross sectional view of the guard from the side of the receptacle, with one set of catch pins released.

FIG. 13 provides a cross sectional view of the guard from the end of the receptacle, with the cover rotated to the open position.

FIG. 14 provides a cross sectional view of the guard from the side of the receptacle, with one cover rotated to the open position.

DETAILED DESCRIPTION OF THE INVENTION

Figures 1, 2, 3:
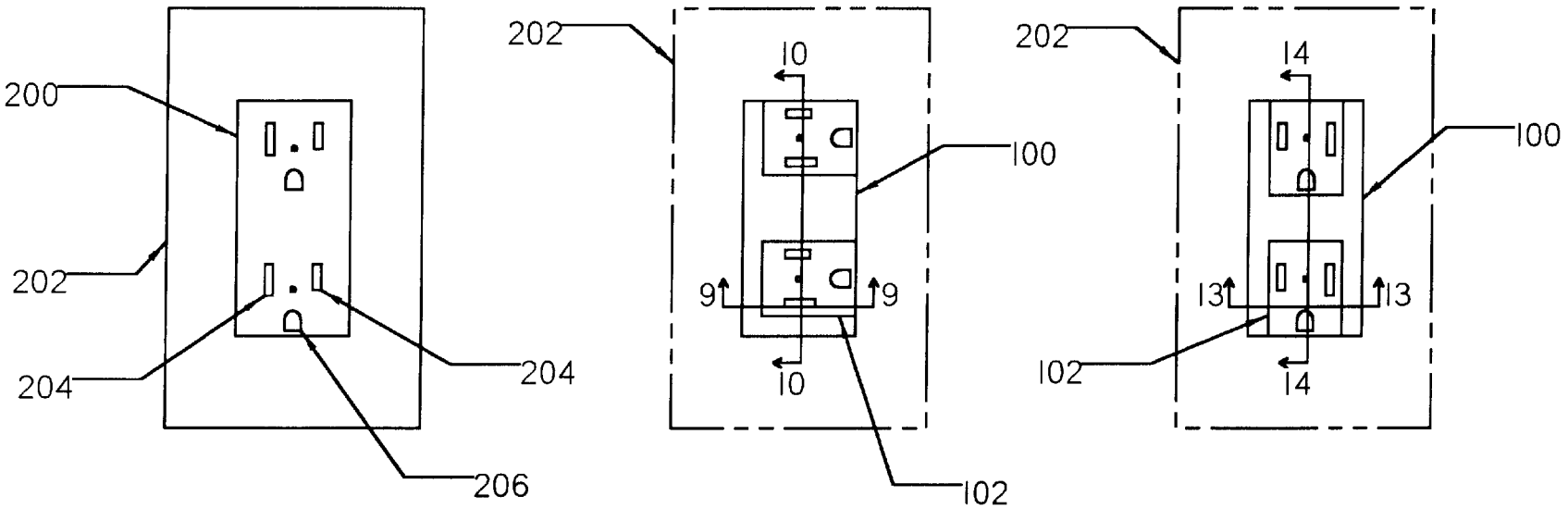
Prior Art FIG. 1
FIG. 1 illustrates a typical prior art electrical receptacle with wall plate.
FIG. 2 illustrates the inventive guard with covers in the closed position.
FIG. 3 illustrates the inventive guard with covers in the open position.

The following discussion focuses on the preferred embodiment of the invention, which is as a guard for a modified 110 volt household receptacle. However, as will be recognized by those skilled in the art, the disclosed apparatus is applicable to a wide variety of situations in which it is desired to provide a guard to an electrical receptacle, including as a retrofit to an existing receptacle.

Glossary

The following is a brief glossary of terms used herein. The supplied definitions are applicable throughout this specification and the claims unless the term is clearly used in another manner.

Catch pin—an element which extends out of the faceplate and through cover to prevent rotation. In the preferred embodiment, there are two catch pins per cover. Fewer or more could be used.

Cover—moving element which rotates to block access to the faceplate.

Crosspiece—element which spans the space between the catch pins and to which the mounting pin and spring attach Faceplate—front plate of the receptacle.

Infant—generally the baby or toddler which the guard is intended to keep from accessing the electrical receptacle. It is intended to encompass others, such as the incompetent or even animals, who are similarly to be blocked from accessing a receptacle.

Inward, Outward—with respect to the receptacle and cover, inward is the direction from the face of the receptacle toward the inside of the receptacle. This is away from the user as the receptacle is typically mounted in a wall and downward in FIGS. 8–15. Outward is the reverse direction: from the inside of the receptacle toward the face of the receptacle, toward the user in a typical wall mounted installation and upward in FIGS. 8–15.

Mounting pin—the pin about which the cover rotates and which connects the cover and crosspiece to the faceplate. Can be implemented as a pin with retainer, a machine screw with nut, or any equivalent means.

Open, Closed—with respect to the cover, open refers to that position in which the slots in the cover are aligned with the corresponding slots in the receptacle, allowing the electrical plug to be inserted. Closed refers to the position which the cover returns to when the electrical plug is removed, blocking access to the receptacle. In the preferred embodiment this is 90 degrees from the open position. Other angular offsets could clearly be used, especially with other receptacle configurations.

Wall plate—the plate which fits around an electrical receptacle to mask the wall opening.

Preferred Embodiment

The disclosed invention is described below with reference to the accompanying figures in which like reference numbers designate like parts. Generally, numbers in the 200's refer to prior art elements or elements in the surrounding environment while numbers in the 100's refer to elements of the invention. In the following discussion, only one cover of the pair on a typical 110 volt receptacle is described and illustrated in operation. It should be understood that both covers function in the same manner.

Overview

A conventional prior art electrical receptacle, 200, is illustrated in FIG. 1 with an accompanying wall plate, 202. Such receptacles exist in various designs but share the common features of two or more openings, 204, into which the prongs of an electrical plug are inserted to mate with the contacts within. These contacts are recessed only slightly within the receptacle and are readily contacted by a foreign object inserted into the openings. Slot, 206, receives the grounding prong.

Figure 5:
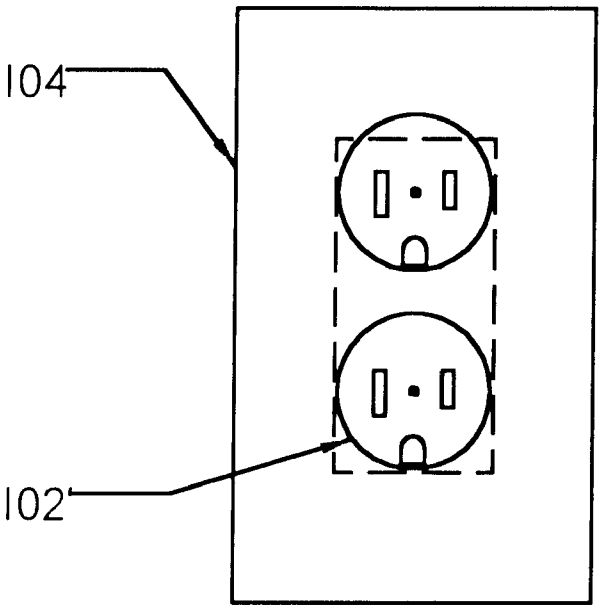
FIG. 5 illustrates an alternative embodiment of the inventive guard with covers integrated into a wall plate, showing the covers in the open position.
Figure 4:
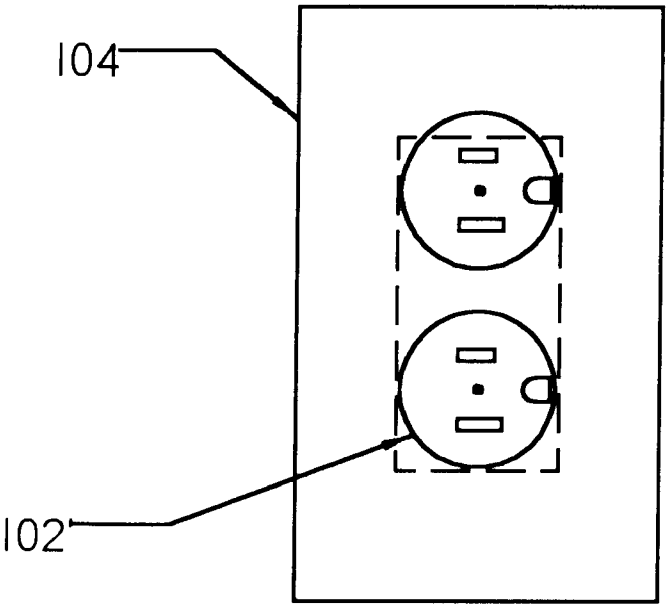
FIG. 4 illustrates an alternative embodiment of the inventive guard with covers integrated into a wall plate, showing the covers in the closed position.

The basic design of the present invention is illustrated by FIGS. 2 & 3. A cover, 102, is used with a modified receptacle, 100, to block access to, or mask, the receptacle openings. When not in use, the cover rotates to its closed position as shown in FIG. 2, blocking access to the hot and neutral openings of the receptacle. The alternative form of FIGS. 4 & 5 also blocks access to the ground opening. When an electrical plug is partially inserted, the cover is unlatched and can be rotated to align with the slots in the receptacle, as shown in FIG. 3. This allows the electrical plug to be fully inserted.

The design of the first embodiment, illustrated in FIGS. 2 & 3 utilizes a substantially rectangular cover. This allows the receptacle to be used with a conventional wall plate as the cover does not extend beyond the edges of the receptacle in either the open or closed positions. A second embodiment, illustrated by FIGS. 4 & 5, utilizes a round cover, and a modified wall plate, 104, allowing the covers to be recessed into the wall plate. This provides more full coverage of the openings in the receptacle and presents a smoother face, but requires the use of a custom wall plate. Clearly other configurations of cover, wall plate, and receptacle can be used to implement the present invention while still being within the scope of the disclosure. The design is also adaptable to single receptacles and receptacles of other design.

Structure

Figure 7:
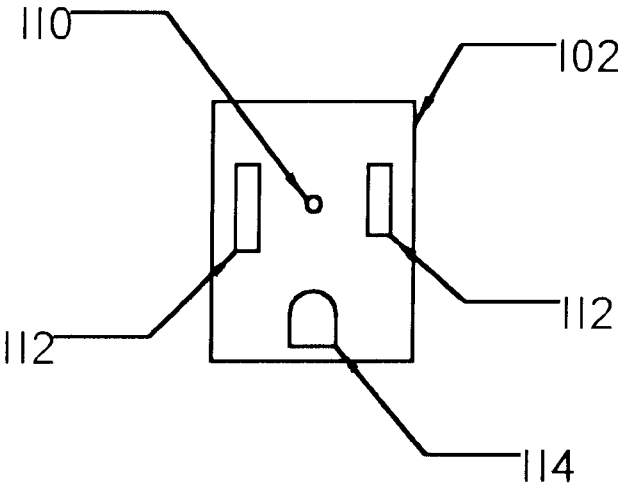
FIG. 7 illustrates the cover.
Figure 6:
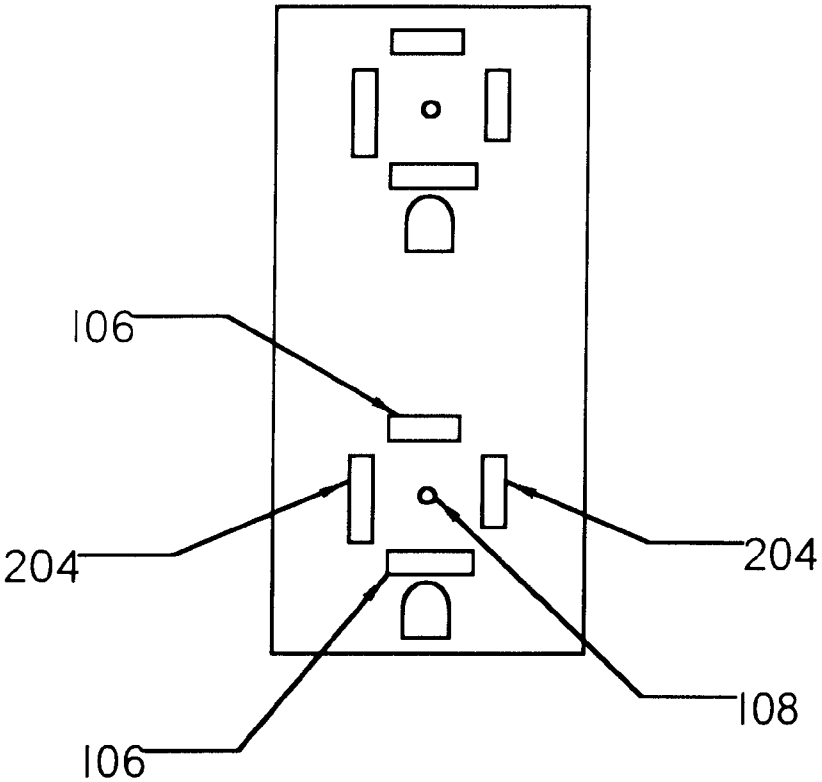
FIG. 6 illustrates the modified receptacle housing showing the added slots.
Figure 8:
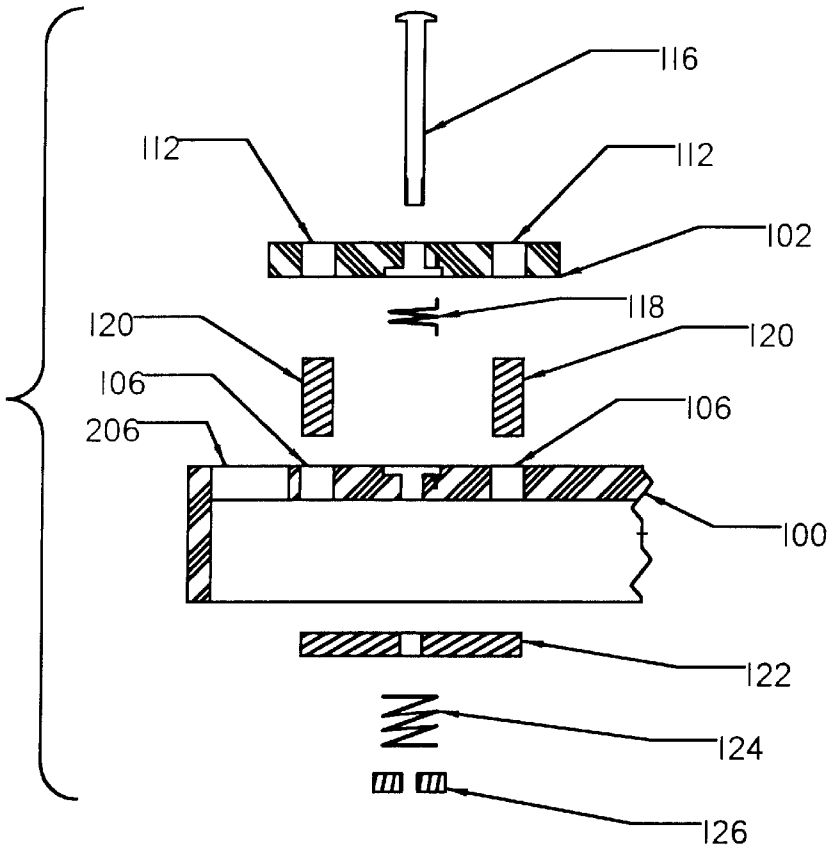
FIG. 8 provides an exploded view of the components of the inventive guard.
Figure 15:
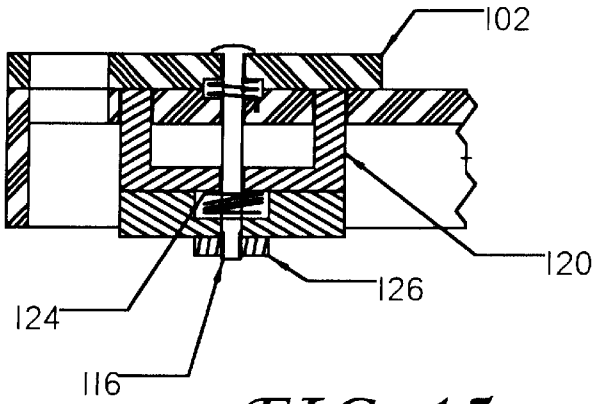
FIG. 15 illustrates an alternative embodiment of the invention with a one piece catch pin and additional stop.

The two major components of the inventive receptacle guard are a modified receptacle housing (hereinafter the receptacle), 100, and a cover, 102, shown individually in FIGS. 6 and 7. The receptacle has slots, 204 and 206, in the conventional configuration to fit a standard 110 volt, 3 prong electrical plug. In addition, the receptacle has slots, 106, to house the catch pins as discussed below. These slots are located in a position rotated 90 degrees from the standard slots, 204, about hole, 108A, which receives the mounting pin which attaches the cover via hole, 110. Slots, 106, align with slots, 112, in the cover when the cover is in its closed position, allowing the catch pins to engage slots, 112. In the preferred embodiment, the cover also includes slot, 114, to allow passage of the ground prong of the electrical plug. If preferred, this slot could be eliminated, allowing use of only ungrounded plugs (where permitted by the applicable electrical code) or the cover could be reduced in size so that it does not mask the ground slot, 206, in the receptacle. The present invention is clearly applicable to other receptacle and plug configurations such as for higher amperage 110 volt applications, single phase or three phase 220 volt, etc.

FIGS. 8–14 illustrate in more detail all of the parts of the inventive receptacle guard and their interrelationship. Mounting pin, 116, and nut, 126, attach all of the parts to the receptacle, 100, and provide the axis about which the cover rotates, and the shaft along which the cross piece, 122, slides. Rotary spring, 118, engages cover, 102, and the receptacle and applies a rotational force to cover causing it to return to its closed position when the electrical plug is removed. Catch pins, 120, are housed in slots, 106, and are adapted to engage slots, 112, in the cover when it is in the closed position. While a single catch pin could be used, the use of at least two pins provides increased security and is preferred. Cross piece, 122, interconnects the catch pins, and connect them to the mounting pin. It also provides a bearing surface for compression spring, 124, which urges the cross piece and catch pins upward to engage the cover. An optional sleeve, not shown, can be fitted around the mounting pin between it and the cross piece and/or spring, 124, to provide a smoother surface for them to bear against. This is especially beneficial where a machine screw is used as the pin and the threads would tend to snag the cross piece or spring, or where a barbed pin is used to engage a retainer used in place of nut, 126.

Operation

The cross section view of FIGS. 9–14 illustrate the operation of the cover and the functioning of the various elements. FIGS. 9 and 10 show the cover in its closed position. Slots, 112, and slots, 106 are aligned. Catch pins, 120, have been pushed toward the face of the receptacle (upward in the drawings) by spring, 124, and cross piece, 122, to fully engage the cover and prevent its rotation. In the preferred embodiment catch pins, 120, are flared and slots, 112, incorporate a matching taper. This helps prevent the catch pins from being pushed too far into the body of the receptacle, possibly catching there. This requires that the catch pins and the cross piece be separate to allow the catch pins to be inserted from the front of the receptacle. If preferred, the flare can be eliminated, allowing the catch pins and cross piece to be manufactured as a single piece, 130 in FIG. 15, simplifying assembly. Nut, 126, and compression spring, 124, would then be relied upon to act as a stop to halt the movement of the cross piece. Alternatively, an additional stop, 128 in FIG. 15, could be used to assure that the catch pins can not be depressed too far into the receptacle.

FIGS. 11 and 12 show the catch pins, 120, depressed into the body of the receptacle, 100, sufficiently to disengage from the cover, 102, compressing spring, 124. This is achieved by the user aligning the prongs of the electrical plug with the slots, 112, in the cover and then pressing inward on the catch pins with the plug. The design of the inventive guard is such that both catch pins must be depressed before the cover is free to rotate. Depressing only one of the catch pins is insufficient to depress the second catch pin sufficiently to release the cover. This can be achieved in several ways. In the preferred embodiment, the fit of the cross piece, 122, to the mounting pin, 116, is sufficiently loose to allow the cross piece to cock at a slight angle relative to the mounting pin when only one catch pin is depressed. Additionally, the cross piece is sufficiently flexible that it will distort slightly when force is applied to only one catch pin, allowing the other catch pin to lag behind and remain engaged. Either of these techniques can be used alone or they can be used in combination. Alternatively, the physical connection of the cross piece can be eliminated, allowing the catch pins completely independent movement. One way in which to achieve this is to replace the cross piece and compression spring with a leaf spring fixed to the mounting pin which independently urges the pins outward. Another is to use separate springs for each catch pin. Additional applicable methods are well known in the art.

With the catch pins depressed, the cover is free to rotate to the position shown in FIGS. 13 and 14, and in FIG. 3. Slots, 112, in the cover align with slots, 204, in the receptacle and allow the electrical plug to be inserted into the receptacle. This rotation works against rotary spring, 118, tightening it. When the electrical plug is removed, the rotary spring will return the cover to its closed position and the compression spring, 124, will urge the catch pins outward into slots, 112, again locking the cover in its closed position.

It should be noted that in order to move the cover from its closed position to its open position, a combination of two movements are required. First, the electrical plug must be positioned and inserted slightly, depressing the catch pins and releasing the cover. Second, the electrical plug and cover must be rotated 90 degrees to align with the slots in the receptacle. The electrical plug can then be fully inserted, mating with the electrical contacts within the receptacle. This dual motion, while simple for an adult to perform is difficult for an infant, increasing the effectiveness of the inventive device well beyond prior art guards which utilize only a single motion.

In the preferred embodiment, there is a slot, 114, in the cover to accommodate the ground prong of the electrical plug, but no corresponding slot in the receptacle. Such a slot has been found unnecessary as the plug can be inserted sufficiently and angled toward the hot and neutral prongs sufficiently to depress the catch pins. This is true even where the ground prong is longer than the other prongs. If preferred, the face of the receptacle could be relieved slightly to provide additional clearance.

Alternative Embodiments

The preferred embodiment utilizes a cover with three slots to accommodate a conventional 110 volt, 3 prong plug. If desired, a cover with only two slots, for the hot and neutral prongs, could be used where this is allowed by the local electrical code. This would allow the cover to be smaller. As discussed above, the inventive guard can also be adapted to other receptacle and plug configurations.

Figure 16:
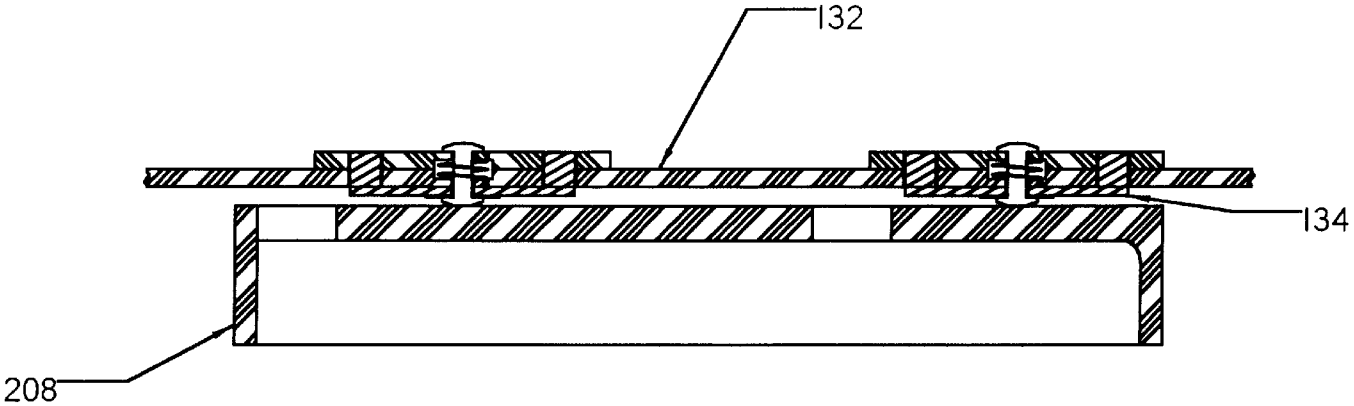
FIG. 16 illustrates an alternative embodiment of the invention with all parts incorporated into a retrofit wall plate and no modifications to the receptacle.

While the preferred embodiment utilizes a modified receptacle, it is also anticipated that the present invention can be utilized as a retrofit to an existing receptacle, see FIG. 16. The guard would be incorporated into a faceplate, 132, which would replace the standard faceplate and attach to the unmodified receptacle, 208. Where sufficiently thin materials are used, the electrical plug will still be able to mate with the contacts in the receptacle. It is likely that a leaf spring arrangement, 134, would be used to avoid the bulk and thickness of the compression spring.

The concept of using dual catch pins to lock the cover in the closed position could also be applied to a guard which utilizes linear motion rather than rotational. While not as secure as the preferred embodiment, this approach would still provide improved security over prior art, non-latching guards, especially where the feature requiring both catch pins to be depressed is incorporated.

In all of the above embodiments, the various springs could be replaced with resilient means arranged to compress and rebound as the relevant part is moved, thus providing the same movement and functionality as the springs. Such a resilient means are considered equivalent.

While the preferred form of the invention has been disclosed above, alternative methods of practicing the invention are readily apparent to the skilled practitioner. The above description of the preferred embodiment is intended to be illustrative only and not to limit the scope of the invention.

I claim:

1. An improved electrical receptacle for preventing an infant from gaining access to said receptacle's electrical contacts, comprising:

a) a housing defining plural slots adapted to provide access to said electrical contacts disposed behind said housing;

b) a cover rotatably mounted to said housing, rotatably movable between at least first and second positions, said cover defining plural openings, said openings adapted to provide access to said housing slots when said cover is in said first position and said cover masking said housing slots when said cover is in said second position;

c) means for urging said cover from said first position toward said second position when not restrained; and d) at least one catch pin adapted to engage one of said cover openings when said cover is in said second position whereby said cover is prevented from moving to said first position without releasing said catch pin and means for urging said catch pin into engagement with said cover opening when aligned therewith.

2. The improved electrical receptacle of claim 1 further comprising a second catch pin adapted to engage a second of said cover openings when said cover is in said second position and means for urging said second catch pin into engagement with said second cover opening, whereby both of said catch pins must be released to move said cover to said first position.

3. The improved electrical receptacle of claim 2 wherein said housing further defines plural catch pin slots adapted to receive said catch pins when said catch pins are released.

4. The improved electrical receptacle of claim 3 wherein said catch pins are adapted to be released by the prongs of an electrical plug when the plug is partially inserted into said cover openings.

5. The improved electrical receptacle of claim 3 wherein said catch pins are tapered and said catch pin slots have a matching taper whereby the range of movement of said catch pins when released is limited.

6. The improved electrical receptacle of claim 1 further comprising:

(a) a wall plate, having an outer face and defining an opening adapted to closely encompass said cover, and wherein said cover has an outer face and wherein said wall plate outer face and said cover outer face are arranged in substantially the same plane; and (b) at least one catch pin adapted to engage one of said cover openings when said cover is in said second position whereby said cover is prevented from moving to said first position without releasing said catch pin and means for urging said catch pin into engagement with said cover opening when aligned therewith.

7. The improved electrical receptacle of claim 6 further comprising a second catch pin adapted to engage a second of said cover openings when said cover is in said second position and means for urging said second catch pin into engagement with said second cover opening, whereby both of said catch pins must be released to move said cover to said first position.

8. The improved electrical receptacle of claim 7 wherein said housing further defines plural catch pin slots adapted to receive said catch pins when said catch pins are released.

9. The improved electrical receptacle of claim 8 wherein said catch pins are adapted to be released by the prongs of an electrical plug when the plug is partially inserted into said cover openings.

10. The improved electrical receptacle of claim 8 wherein said catch pins are tapered and said catch pin slots have a matching taper whereby the range of movement of said catch pins when released is limited.

11. An improved electrical receptacle, having electrical contacts, comprising:

a) a housing defining plural slots adapted to provide access to the electrical contacts disposed behind said housing;

b) a cover movably mounted to said housing, movable between at least first and second positions, said cover defining plural openings, said openings adapted to provide access to said housing slots when said cover is in said first position and said cover masking said housing slots when said cover is in said second position;

c) means for urging said cover from said first position toward said second position when not restrained;

d) at least one catch pin adapted to engage one of said cover openings when said cover is in said second position whereby said cover is prevented from moving to said first position without releasing said catch pin; and e) means for urging said catch pin into engagement with said cover opening when aligned therewith.

12. The improved electrical receptacle of claim 11 further comprising a second catch pin adapted to engage a second of said cover openings when said cover is in said second position and means for urging said second catch pin into engagement with said second cover opening, whereby both of said catch pins must be released to move said cover to said first position.

13. The improved electrical receptacle of claim 12 wherein said catch pins are adapted to be released by the prongs of an electrical plug when the plug is partially inserted into said cover openings.

14. The improved electrical receptacle of claim 12 wherein said housing further defines plural catch pin slots adapted to receive said catch pins when said catch pins are released.

15. The improved electrical receptacle of claim 14 wherein said catch pins are tapered and said catch pin slots have a matching taper whereby the range of movement of said catch pins when released is limited.

16. The improved electrical receptacle of claim 11 wherein said cover is rotatably mounted and moves between said first and second positions by rotating.

17. A receptacle guard to prevent are infant from gaining access to the electrical contacts of an electrical receptacle, the receptacle comprising a housing defining plural slots adapted to provide access to plural the electrical contacts disposed behind said housing, said receptacle guard comprising:

a) a wall plate adapted to be mounted to the receptacle housing;

b) a cover rotatably mounted to said wall plate, rotatable movable between at least first and second positions, said cover defining plural openings, said openings adapted to provide access to the housing slots when said cover is in said first position and said cover masking the housing slots when said cover is in said second position;

e) means for urging said cover from said first position toward said second position when not restrained;

f) plural catch pins, each adapted to engage one of said cover openings when said cover is in said second position whereby said cover is prevented from moving to said first position without releasing said at least two of said catch pins; and g) means for urging said catch pins into engagement with said cover openings when aligned therewith.

18. The receptacle guard of claim 17 wherein said catch pins are adapted to be released by the prongs of an electrical plug when the plug is partially inserted into said cover openings.

* * * * *